US011459806B1

(12) United States Patent
Bishop

(10) Patent No.: US 11,459,806 B1
(45) Date of Patent: Oct. 4, 2022

(54) DOOR PROP

(71) Applicant: David Bishop, Ocean Springs, MI (US)

(72) Inventor: David Bishop, Ocean Springs, MI (US)

( * ) Notice: Subject to any disclaimer, the term of this patent is extended or adjusted under 35 U.S.C. 154(b) by 262 days.

(21) Appl. No.: 16/837,240

(22) Filed: Apr. 1, 2020

(51) Int. Cl.

| | |
|---|---|
| ***E05C 17/14*** | (2006.01) |
| ***E05C 19/00*** | (2006.01) |
| ***E05C 17/00*** | (2006.01) |
| ***E05C 17/54*** | (2006.01) |

(52) U.S. Cl.
CPC ..... *E05C 17/14* (2013.01); *E05C 17/025* (2013.01); *E05C 17/54* (2013.01); *E05C 19/007* (2013.01); *E05C 19/008* (2013.01); *E05Y 2201/218* (2013.01); *E05Y 2201/224* (2013.01); *E05Y 2900/132* (2013.01); *E05Y 2900/531* (2013.01); *Y10S 292/15* (2013.01); *Y10T 292/34* (2015.04); *Y10T 292/37* (2015.04); *Y10T 292/65* (2015.04); *Y10T 292/67* (2015.04); *Y10T 292/71* (2015.04); *Y10T 292/73* (2015.04)

(58) Field of Classification Search
CPC ... Y10T 292/34; Y10T 292/37; Y10T 292/65; Y10T 292/67; Y10T 292/71; Y10T 292/73; E05C 17/14; E05C 17/54; E05C 17/2015; E05C 17/025; E05Y 2900/132; E05Y 2900/531; Y10S 292/15
USPC ..... 49/449, 364, 379
See application file for complete search history.

(56) References Cited

U.S. PATENT DOCUMENTS

| | | | | | |
|---|---|---|---|---|---|
| 362,239 | A * | 5/1887 | Abrams | E05B 65/0007 | 292/342 |
| 1,385,208 | A * | 7/1921 | Geddes | E05F 7/04 | 292/76 |
| 2,376,117 | A * | 5/1945 | Bright | E05C 17/54 | D8/402 |
| 2,851,870 | A * | 9/1958 | Eckel | E05C 19/182 | 292/288 |
| 2,870,281 | A * | 1/1959 | Mitchell | H01H 3/161 | 200/61.93 |
| 2,916,902 | A * | 12/1959 | Wamsley | E05C 17/36 | 292/DIG. 43 |
| 2,919,946 | A * | 1/1960 | Miener | E05C 17/36 | 292/DIG. 43 |
| 2,973,217 | A * | 2/1961 | Gregoire | E05C 17/042 | 292/DIG. 43 |
| 2,998,276 | A * | 8/1961 | Shettler | B65D 45/28 | 292/288 |
| 3,011,818 | A * | 12/1961 | Matthiessen | E05C 17/36 | 292/DIG. 43 |
| 3,328,064 | A * | 6/1967 | Simon | E05C 17/36 | 292/288 |
| 3,589,760 | A * | 6/1971 | Williams | B65D 45/02 | 292/259 R |
| 3,640,558 | A * | 2/1972 | Gewertz | E05C 17/365 | 292/264 |
| 3,726,555 | A * | 4/1973 | Lawson | E05C 19/182 | 292/288 |

(Continued)

*Primary Examiner* — Christine M Mills
*Assistant Examiner* — Faria F Ahmad
(74) *Attorney, Agent, or Firm* — Cramer Patent & Design, PLLC; Aaron R. Cramer

(57) ABSTRACT

A door prop includes a rectangular wedge secured horizontally by a first elastic cord in a horizontal position adjacent the door frame upon a door when the door is open. A second elastic cord enables a user to move the wedge away from propping the door when the door is desired to be closed.

17 Claims, 3 Drawing Sheets

(56) References Cited

U.S. PATENT DOCUMENTS 3,891,257 A * 6/1975 Wilson ..... E05C 17/36 292/262
3,914,965 A * 10/1975 Paxton ..... E05B 67/365 292/281
4,022,503 A * 5/1977 Bey ..... E05C 19/182 292/264
4,070,050 A * 1/1978 Glock ..... E05C 21/005 292/339
4,076,293 A * 2/1978 Valles ..... E05C 19/004 292/338
4,136,899 A * 1/1979 Frasher ..... E05C 19/004 292/338
4,191,413 A * 3/1980 Barner ..... E05C 17/36 24/302
4,372,592 A * 2/1983 Beese ..... E05C 19/18 292/288
4,648,152 A 3/1987 Grewell
4,666,194 A * 5/1987 Charman ..... F01N 11/00 296/76
4,667,993 A * 5/1987 Hannesson ..... E05C 17/042 24/298
4,688,761 A * 8/1987 Wilcox ..... B25B 27/0035 29/239
4,889,372 A * 12/1989 Dege ..... E05C 17/365 292/264
4,900,075 A * 2/1990 Smith ..... E05B 67/383 292/264
5,011,203 A * 4/1991 Tackett ..... E05C 17/54 292/DIG. 60
5,048,150 A * 9/1991 Guerin ..... E05C 17/30 292/306
5,280,977 A * 1/1994 Piva ..... E05C 19/182 292/296
5,291,631 A * 3/1994 Schjoneman ..... E05C 17/54 16/82
5,447,345 A * 9/1995 Daley ..... E05C 19/003 292/259 R
5,501,494 A * 3/1996 Willetts ..... E05C 19/182 292/288
5,509,235 A 4/1996 Chander
5,542,723 A * 8/1996 Scharf ..... E05C 17/54 292/288
5,586,793 A * 12/1996 Davenport ..... E05C 5/02 292/288
5,647,619 A * 7/1997 DeLisio ..... E05C 17/042 292/288
5,680,675 A 10/1997 Davis
5,687,879 A * 11/1997 King ..... A47G 19/145 292/288
6,102,238 A * 8/2000 Brady ..... A47J 36/10 220/756
6,394,510 B1 * 5/2002 Stewart, III ..... E05B 65/0888 292/264
6,616,128 B2 * 9/2003 Selzer ..... A62B 3/005 52/712
6,648,381 B2 * 11/2003 Holton ..... E05C 17/36 292/288
6,863,319 B1 * 3/2005 Bentley ..... E05C 17/36 292/288
7,014,229 B1 3/2006 Stelmach
7,175,213 B1 * 2/2007 Blangiardo ..... E05B 13/002 292/288
8,534,721 B1 9/2013 Boggs
8,616,593 B2 * 12/2013 Bruce ..... E05C 17/042 292/288
8,756,965 B1 * 6/2014 Anderson ..... E05B 13/001 292/264
8,870,249 B2 * 10/2014 Bruce ..... B60P 7/0823 292/288
8,960,739 B2 * 2/2015 Duff ..... E05C 17/025 16/86 A
9,085,923 B1 * 7/2015 McWhinney ..... E05C 17/54
9,115,517 B2 8/2015 Clay et al.
9,605,456 B2 3/2017 Booker et al.
9,644,407 B1 5/2017 Abramovits
9,976,324 B1 * 5/2018 Edwards ..... E05B 13/002
10,094,158 B2 10/2018 McRoskey et al.
10,113,350 B2 * 10/2018 Brown ..... E05F 7/00
10,316,558 B2 * 6/2019 Patton ..... E05C 19/004
11,149,476 B2 * 10/2021 Miller ..... E05C 17/54
2003/0234546 A1 * 12/2003 Engel ..... E05C 19/003 292/339
2004/0183315 A1 * 9/2004 O'Donohoe ..... E05B 13/002 292/288
2005/0116479 A1 * 6/2005 Lin ..... E05C 19/182 292/288
2006/0071482 A1 * 4/2006 Tang ..... E05B 19/20 292/288
2006/0097123 A1 * 5/2006 Gallien ..... A47B 97/00 248/500
2006/0279093 A1 * 12/2006 Tang ..... E05C 17/166 292/288
2007/0085352 A1 * 4/2007 Ulanday ..... E05C 17/365 292/288
2008/0029522 A1 * 2/2008 Brown ..... F25D 21/14 220/592.2
2008/0042451 A1 * 2/2008 Moore ..... E05C 19/18 292/288
2009/0167048 A1 * 7/2009 Luca ..... E05C 17/36 296/76
2011/0133494 A1 * 6/2011 Hopkins ..... E05C 19/18 292/253
2011/0167880 A1 * 7/2011 Klementowicz, III ..... E05B 75/00 70/16
2011/0254293 A1 * 10/2011 Duff ..... E05C 17/54 292/343
2012/0217762 A1 * 8/2012 Bruce ..... E05C 17/042 292/253
2013/0001962 A1 * 1/2013 Wheelwright ..... F16G 11/03 292/288
2015/0097382 A1 * 4/2015 Blawat ..... E05C 17/56 292/288
2015/0204122 A1 * 7/2015 Edwards ..... E05C 19/184 292/288
2015/0225989 A1 * 8/2015 Edwards ..... E05C 17/365 292/288
2020/0300009 A1 * 9/2020 Miller ..... E05C 17/025

* cited by examiner

DOOR PROP

RELATED APPLICATION

None.

FIELD OF THE INVENTION

The presently disclosed subject matter is directed to a prop for holding open a door.

BACKGROUND OF THE INVENTION

The standard garden shed is a typical site in backyards the world over. They do an excellent job of holding large tools, supplies, and equipment necessary to care for one's yard and gardens. They save valuable space in home and garages as well. Such sheds are typically provided with one or two large doors to allow for movement of large equipment such as riding mowers. As these doors have a large surface area, they are easily blown close, leaving the user closed inside perhaps without any light, or constantly bang into the user as he or she is trying to move items and material in and out of the shed.

While a doorstop could be used, many of these doors are located far above grade making such wedges useless. Accordingly, there exists a need for a means by which shed doors and other large doors can be automatically locked open in a manner which addresses the above problems. The development of the door prop fulfills this need.

SUMMARY OF THE INVENTION

The principles of the present invention provide for a door prop which comprises a first cord having a first hook which is located at a first end of the first cord and a second hook which is located at a second end of the first cord; a second cord which has a first end and a second end and a wedge which has a first end and a second end. The wedge is attached to an upper part of a door frame of a door with a wedge fastener.

The first cord may be made of elastic material while the second cord may be horizontally aligned with a door handle. A first end of the second cord may be formed as a cord loop and a third hook may be located at a second end of the second cord. The cord loop may be formed to enable passage of a portion of a wedge eyelet and the passage of the first hook of the first cord. The wedge eyelet may extend away from a side edge of the first end of the wedge which is attached to the first hook of the first cord and the cord loop of the second cord which is adjacent to an upper part of the door side edge.

The door prop may further comprise a cord end fastener which fastens the first end of the second cord to itself to form the cord loop. The cord end fastener may be a crimping device. The third hook may be removably attached to a second door eyelet which may be attached to a face of the door. The second door eyelet may be located adjacent the door side edge and may be generally horizontally aligned with the door handle. The second cord may be made of elastic material while the second hook may be removably attached to a first door eyelet which may be attached to a face of the door. The first door eyelet may be located adjacent the door upper edge.

The door prop may further comprise a third door eyelet which may be mounted on to the door in vertical alignment with the second door eyelet. The second cord may pass through the third door eyelet to provide slight tensioning to the second cord that may be transferred to the first cord and the wedge to aid in biasing the wedge against the door side edge. The door prop may further comprise at least one washer which may be placed on the wedge fastener between the door frame and the wedge to facilitate a pivoting motion of the wedge when it is attached. The wedge may have a rectangular prism shape and may be weatherproof, made of stainless steel and/or made of wood.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
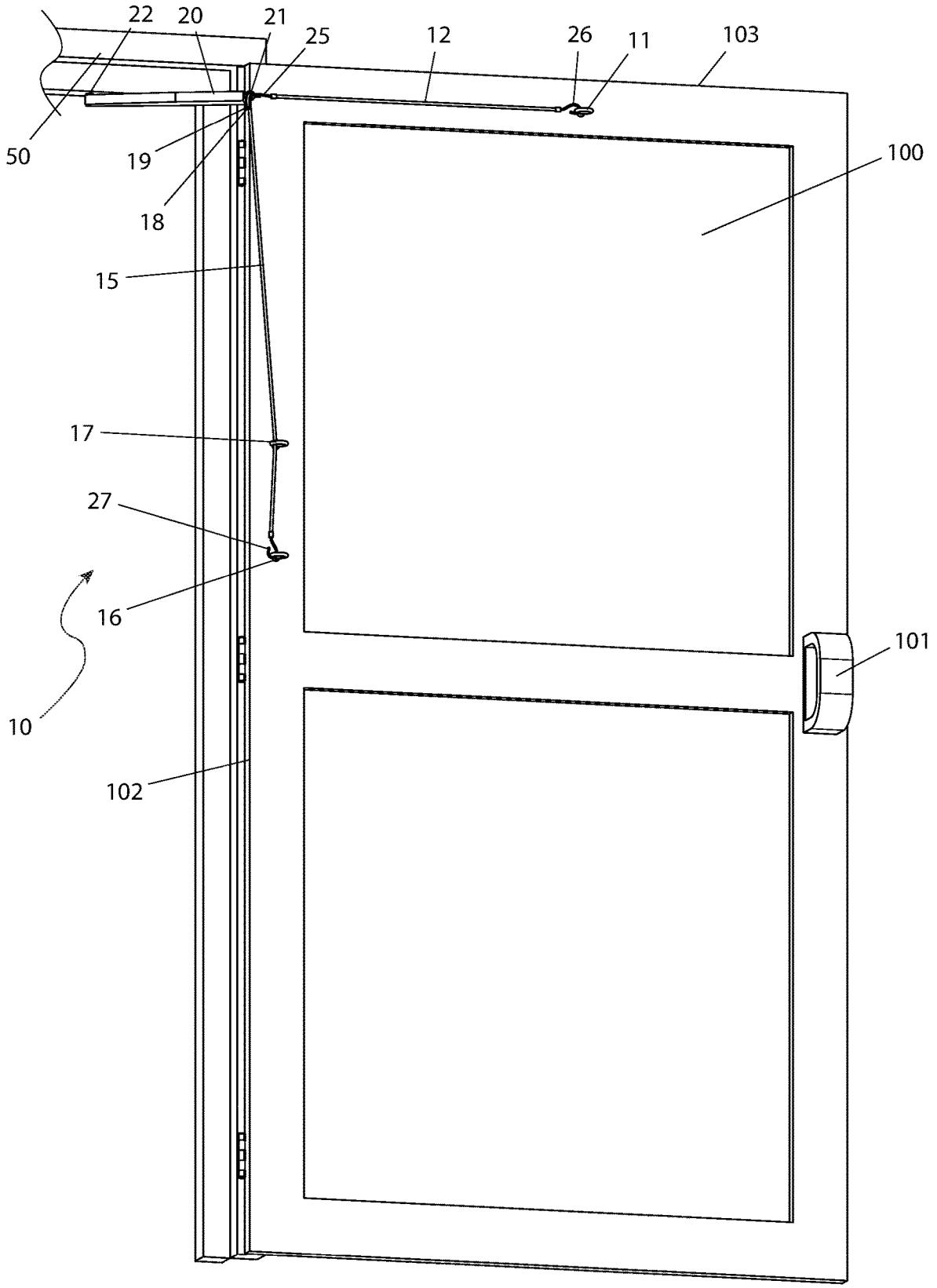
FIG. 1 is an environmental view of the door prop 10 as installed on a door 100, according to the preferred embodiment of the present invention.

10 door prop
11 first door eyelet
12 first cord
15 second cord
16 second door eyelet
17 third door eyelet
18 cord loop
19 cord end fastener
20 wedge
21 wedge eyelet
22 washer
25 first hook
26 second hook
27 third hook
50 door frame
55 wedge fastener
75 user
76 first hand
77 second hand
100 door
101 door handle
102 door side edge
103 door upper edge

DESCRIPTION OF THE PREFERRED EMBODIMENTS

Figure 2:
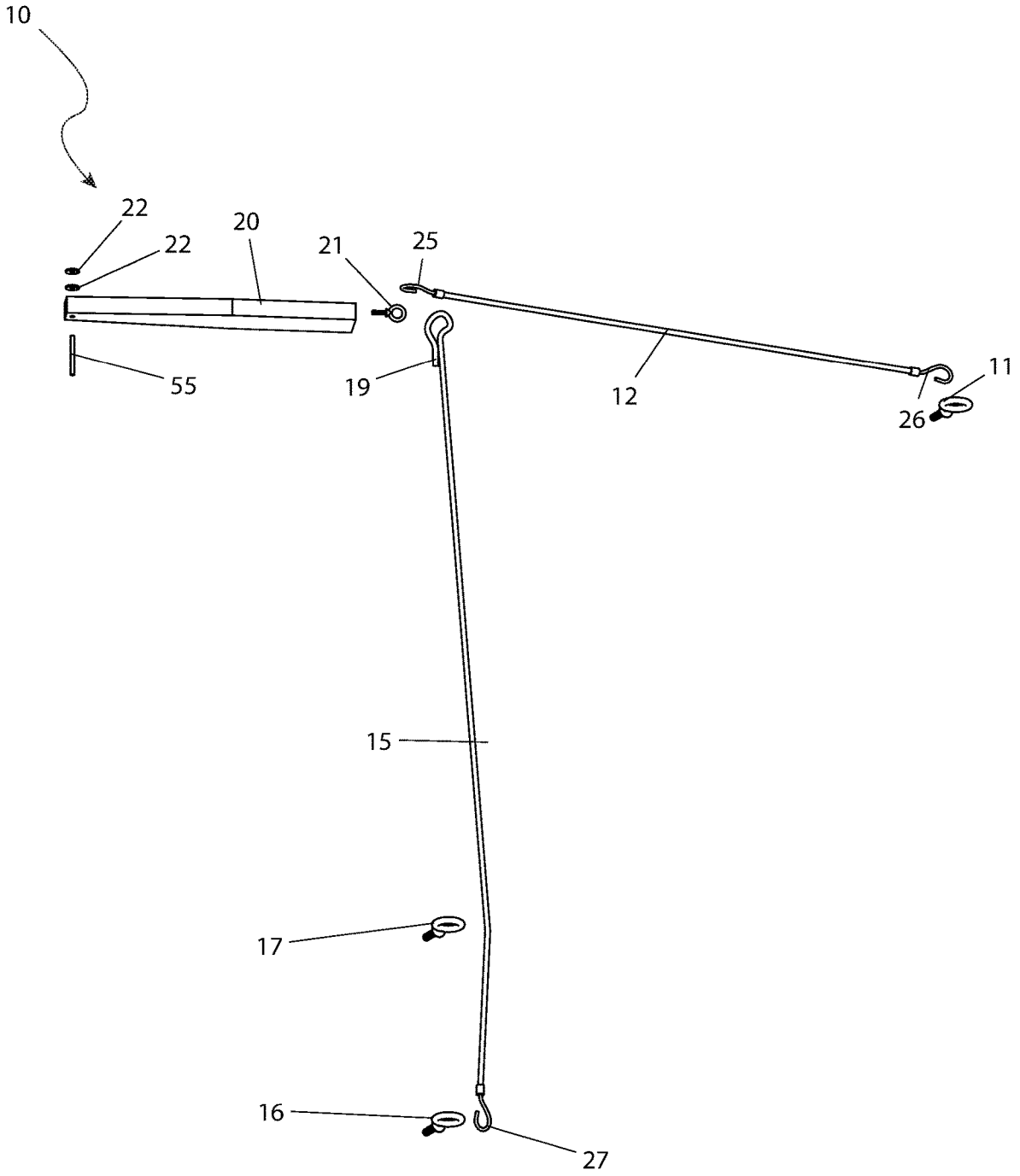
FIG. 2 is an exploded view of the components of the door prop 10, according to the preferred embodiment of the present invention; and, FIG. 3 is an environmental view of the door prop 10 as installed on a door 100 and being manipulated by a user 75, according to the preferred embodiment of the present invention.
Figure 3:
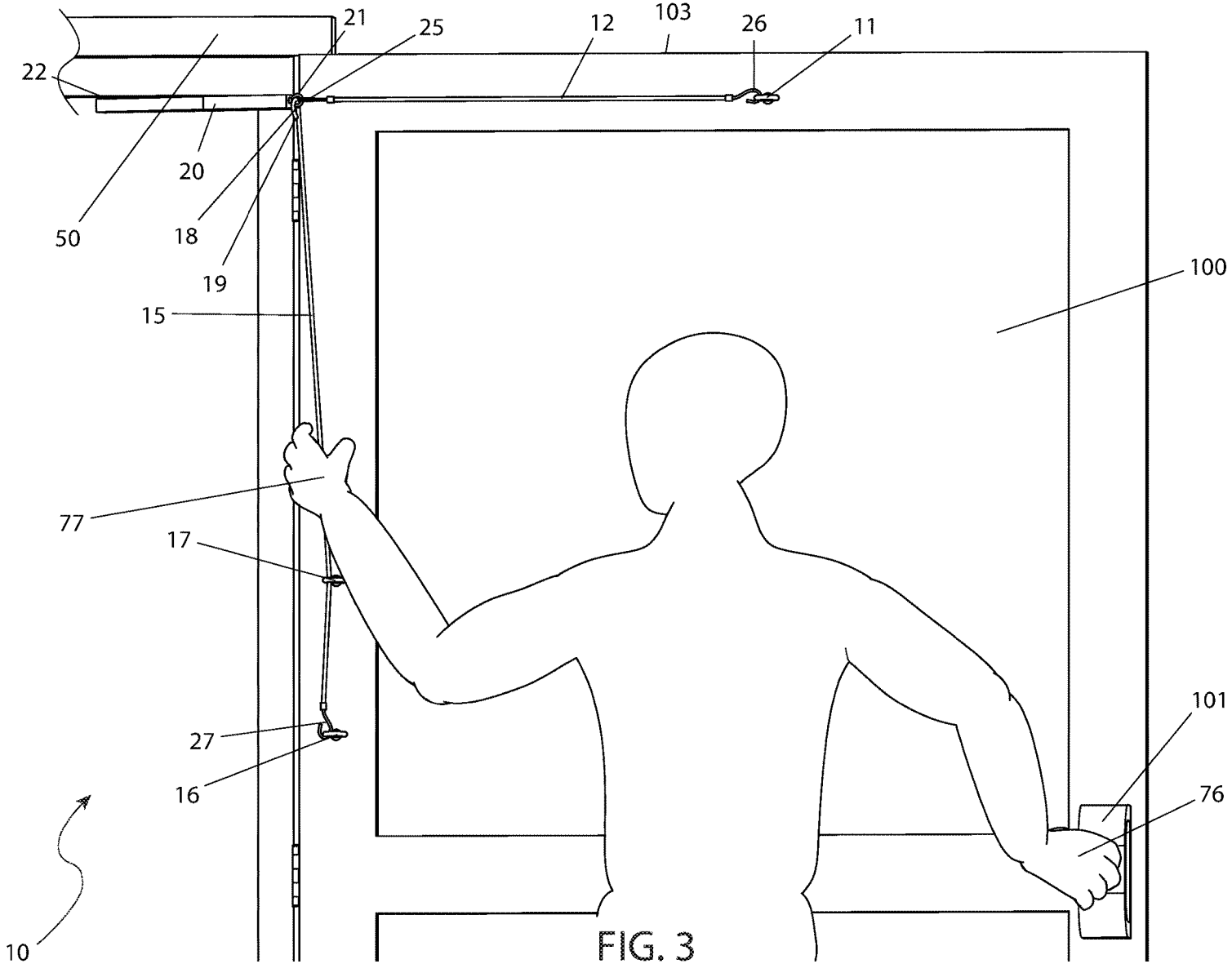

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

FIG. 1 illustrates an environmental view of a door prop 10 as it is installed on a door 100. The door 100 can be any door that closes an opening of a structure, such as a residence, barn, or similar structure. The door 100 is hingedly mounted to a side of a door frame 50 as is common in the typical fashion. The door prop 10 has a first portion and a second portion each preferably mounted to a side of the door 100 intended to be propped open and a third portion mounted to an upper inner side of the door frame 50. In the illustrated embodiment of FIG. 1, the door 100 is open to the right and as such has the right side hingedly mounted to a side of the door frame 50. The first portion of the door prop 10 is mounted to an inner side of the door 100, adjacent the top thereof and preferably centrally located. The second portion of the door prop 10 is mounted at a midpoint of the left side of the door 100, relatively horizontally aligned with a door handle 101. The third portion of the door prop 100 is mounted to a lower surface of the upper part of the door frame 100, adjacent to a left side of the door frame 50, or in the case of a double door, adjacent to the center of the upper part of the door frame 50.

Referring now to FIG. 2, an exploded view of all the components of the invention, is herein described. A first portion includes a first cord 12 having a first hook 25 located at a first end and a second hook 26 located at a second end. The first cord 12 is preferably an elastic material, similar in function as or identical with a Bungee cord. Additionally, other adjustable means for the first cord 12 can be envisioned, such as a spring, tri-glide, buckle, or the like. The second hook 26 is removably attached to a first door eyelet 11. The first door eyelet 11 is configured to be affixed or otherwise attached to a face of the door 100. In an exemplary embodiment, the first door eyelet 11 is located adjacent the door upper edge 103.

A second portion includes a second cord 15, with a portion of the second cord 15 formed as a cord loop 18 at a first end and having a third hook 27 located at a second end. The second cord 15 can be manufactured or supplied as similar or identical to the material of the first cord 12, (i.e.; preferably an elastic material, similar in function as or identical with a Bungee cord). Additionally, other adjustable means for the second cord 15 can be envisioned, such as a spring, tri-glide, buckle, or the like. The cord loop 18 is formed to enable passage of a portion of a wedge eyelet 21 and/or the passage of the first hook 25 of the first cord 12. A cord end fastener 19 fastens the free first end of the second cord 15 to itself, thus forming the cord loop 18. The cord end fastener 19 can be a crimping device, a clamp, or anything that can either make the cord loop 18 a permanent or adjustable diameter, but functions to aid in resiliently forming the cord loop 18. The third hook 27 is configured to be removably attached to a second door eyelet 16. The second door eyelet 16 is affixed or otherwise attached to the same face of the door 100 as the first door eyelet 11. In an exemplary embodiment, the second door eyelet 16 is located adjacent the door side edge 102 and generally horizontally aligned with the door handle 101.

The third portion includes a wedge 20. The wedge 20 is preferably a rectangular prism in shape and has a material enabling it to be resilient and weatherproof, capable of withstanding repeated usage and in outdoor environment. As such, the wedge 20 is typically a stainless steel, wooden, or other similar material. The wedge 20 has a first end and a second end. A wedge eyelet 21 extends away from a side edge of the first end of the wedge 20 and is configured to attach to the first hook 25 of the first cord 12 and the cord loop 18 of the second cord 15 adjacent the upper part of the door side edge 102. An upper side of the second end of the wedge 20 is attached to an upper part of the door frame 50 with a wedge fastener 55. At least one (1) washer 22 (in the exemplary embodiment, there are two (2) washers 22, each approximately one-sixteenth of an inch (1/16 in.) thick and one inch (1 in.) in diameter), that are placed on the wedge fastener 55 between the door frame 50 and the wedge 20 to facilitate a pivoting motion of the wedge 20 when it is attached.

A third door eyelet 17 can be mounted on to the door 100 in vertical alignment with the second door eyelet 16. The second cord 15 can pass through this third door eyelet 17 to provide slight tensioning to the second cord 15 that is transferred to the first cord 12 and the wedge 20 to aid in biasing the wedge 20 against the door side edge 102.

2. Operation of the Preferred Embodiment

The preferred embodiment of the present invention can be utilized by the common user in a simple and effortless manner with little or no training. It is envisioned that the door prop 10 would be installed on a desired door 100 and door frame 50 in general accordance with FIG. 1. The components of the door prop 10 are more clearly illustrated in FIG. 2, wherein a method of use of an exemplary embodiment of the door prop 10 is illustrated in FIG. 3. The user would procure the door prop 10 from conventional procurement channels such as mechanical supply shops, home improvement stores, hardware stores, mail order and internet supply houses and the like. Special attention would be paid to materials of the door prop 10.

After procurement and prior to utilization, the door prop 10 would be installed on the door 100 to where it is desired to selectively prop open. A first door eyelet 11 is affixed to an upper central location on a first side of the door 100, adjacent the door upper edge 103. A second door eyelet 16 is affixed to the same side of the door, adjacent the door side edge 103 of the door 100 that is not hingedly attached to the door frame 50. The second door eyelet 16 is located generally on the same horizontal alignment plane as the door handle 101. If desired, the third door eyelet 17 is affixed to the same side of the door, adjacent the door side edge 102 of the door 100 that is not hingedly attached to the door frame 50. Such a third eyelet 17 is preferably vertically aligned with the second eyelet 16 and distanced at approximately two inches (2 in.) therefrom. A second side of the wedge 20 is pivotally attached to a lower surface of an upper part of the door frame 50 with a wedge fastener 55. A second hook 26 located at a second end of the first cord 12 is attached to the first door eyelet 11. A third hook 27 of the second end of the second cord 15 is attached to the second door eyelet 16. The first end of the second cord 15 passes through the third door eyelet 16 (if so provided). The first hook 25 of the first end of the first cord 12 then either passes through the cord loop 18 and affixes onto the wedge eyelet 21 of the wedge 20 or simultaneously attaches to the cord loop 18 and wedge eyelet 21.

FIG. 3 illustrates an exemplary method of operating the door prop 10. When the door 100 is closed, in order to set the wedge 20 against the door side edge 102, a user 75 grasps the door handle 101 with either or both hands 76, 77 and opens the door 100 fully. The tension on the first cord 12 and second cord 15 to travel with the door 100 pivots the wedge 20 such that the portion of the wedge 20 that is adjacent the door 100 buts up against the door side edge 102 and inner surface of the side of the door frame 50, thereby fully propping the door 100 open, In this instance, the wedge eyelet 21 is located in such a manner as to not interfere with this act. When it desired to remove the wedge 20 from propping the door 100 open, the user 75 grasps the door handle 101 with a first hand 76 to force the door 100 even more open while grasping the second cord 15 with a second hand 77. A pulling force particularly perpendicularly away from the door 100 where the first door eyelet 11, second door eyelet 16, and third door eyelet 17 are affixed with causes the wedge 20 to move in a similar direction, yet away from abutting against the door side edge 102 and inner side surface of the door frame 50, thus freeing the wedge 20 and allowing the door 100 to fully close.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A door prop, comprising:

a first cord having a first hook located at a first end of the first cord and a second hook located at a second end of the first cord;

a second cord having a first end and a second end; and a wedge having a first end and a second end, the wedge is attached to an upper part of a door frame of a door with a wedge fastener;

wherein a first end of the second cord is formed as a cord loop and a third hook located at a second end of the second cord;

wherein a wedge eyelet extends away from a side edge of the first end of the wedge attached to the first hook of the first cord and the cord loop of the second cord adjacent to an upper part of a door side edge; and wherein the third hook is removably attached to a second door eyelet attached to a face of the door.

2. The door prop according to claim 1, wherein the first cord is made of elastic material.

3. The door prop according to claim 1, wherein the second cord is horizontally aligned with a door handle.

4. The door prop according to claim 1, wherein the cord loop is formed to enable passage of a portion of the wedge eyelet and the passage of the first hook of the first cord.

5. The door prop according to claim 1, further comprising a cord end fastener fastening the first end of the second cord to itself to form the cord loop.

6. The door prop according to claim 5, wherein the cord end fastener is a crimping device.

7. The door prop according to claim 1, wherein the second door eyelet is located adjacent the door side edge.

8. The door prop according to claim 1, wherein the second cord is made of elastic material.

9. The door prop according to claim 1, wherein the second hook is removably attached to a first door eyelet attached to a face of the door.

10. The door prop according to claim 9, wherein the first door eyelet is located adjacent the door upper edge.

11. The door prop according to claim 1, further comprising a third door eyelet mounted on to the door in vertical alignment with the second door eyelet.

12. The door prop according to claim 11, wherein the second cord passes through the third door eyelet to provide slight tensioning to the second cord that is transferred to the first cord and the wedge to aid in biasing the wedge against the door side edge.

13. The door prop according to claim 1, further comprising at least one washer is placed on the wedge fastener between the door frame and the wedge to facilitate a pivoting motion of the wedge when it is attached.

14. The door prop according to claim 1, wherein the wedge has a rectangular prism shape.

15. The door prop according to claim 1, wherein the wedge is weatherproof.

16. The door prop according to claim 1, wherein the wedge is made of stainless steel.

17. The door prop according to claim 1, wherein the wedge is made of wood.

* * * * *